US012110707B2

(12) United States Patent
Roy et al.

(10) Patent No.: US 12,110,707 B2
(45) Date of Patent: Oct. 8, 2024

(54) SWIMMING POOL/SPA GAS HEATER INLET MIXER SYSTEM AND ASSOCIATED METHODS

(71) Applicant: Hayward Industries, Inc., Charlotte, NC (US)

(72) Inventors: William Julian Roy, Thompson's Station, TN (US); Benjamin Isaac Corn, Columbia, TN (US)

(73) Assignee: Hayward Industries, Inc., Charlotte, NC (US)

( * ) Notice: Subject to any disclaimer, the term of this patent is extended or adjusted under 35 U.S.C. 154(b) by 0 days.

(21) Appl. No.: 17/490,917

(22) Filed: Sep. 30, 2021

(65) Prior Publication Data

US 2022/0136269 A1 May 5, 2022

Related U.S. Application Data

(60) Provisional application No. 63/107,380, filed on Oct. 29, 2020.

(51) Int. Cl.
*E04H 4/12* (2006.01)
*F24H 1/00* (2022.01)

(52) U.S. Cl.
CPC ..... *E04H 4/129* (2013.01); *F24H 1/0027* (2013.01)

(58) Field of Classification Search
CPC ..... B01F 25/314231
See application file for complete search history.

(56) References Cited

U.S. PATENT DOCUMENTS

| | | | |
|---|---|---|---|
| 176,964 | A | 5/1876 | Johnson |
| 556,630 | A | 3/1896 | Hoberecht |
| 753,250 | A | 3/1904 | Ebinger |
| 1,618,485 | A | 2/1927 | Skinner |
| 1,664,509 | A | 4/1928 | Harper |
| 1,690,501 | A | 11/1928 | Potts |
| 1,742,362 | A | 1/1930 | Ludt |

(Continued)

FOREIGN PATENT DOCUMENTS

| | | | |
|---|---|---|---|
| DE | 3239950 | A1 | 5/1984 |
| DE | 3703282 | A1 | 8/1988 |

(Continued)

OTHER PUBLICATIONS

Hold Rite, Quick Shed Water Heater Enclosure (Year: 2014).*

(Continued)

*Primary Examiner* — Steven S Anderson, II
*Assistant Examiner* — Kurt J Wolford
(74) *Attorney, Agent, or Firm* — McCarter & English, LLP

(57) ABSTRACT

An inlet mixer system for a gas heater includes a housing in fluid communication with an inlet of a combustion blower, and first and second mixer inserts, each removably positionable within the housing. Each mixer insert includes a body defining a mixing chamber, an air intake, and a plurality of orifices disposed radially about the body and extending through the body, which provide respective volumetric flow rates of a fuel gas. When the first mixer insert is positioned within the housing, the inlet mixer system is configured for use with a first fuel gas, and when the second mixer insert is positioned within the housing, the inlet mixer system is configured for use with a second fuel gas.

36 Claims, 13 Drawing Sheets

(56) References Cited

U.S. PATENT DOCUMENTS 1,775,041 A 9/1930 Karmazin
1,836,242 A 12/1931 Harper
1,927,325 A 9/1933 Ritter
1,940,804 A 12/1933 Karmazin
2,042,812 A 6/1936 Tull et al.
2,055,499 A 9/1936 King
2,106,310 A 1/1938 Warrick
2,132,372 A 10/1938 Locke
2,184,345 A 12/1939 Hersey
2,259,433 A 10/1941 Kitto
2,335,085 A 11/1943 Roberts
2,381,215 A 8/1945 Hahn
2,884,197 A 4/1959 Whittell, Jr.
2,950,092 A 8/1960 DiNiro
2,994,123 A 8/1961 Kritzer
3,080,916 A 3/1963 Collins
3,182,481 A 5/1965 Oddy et al.
3,227,175 A 1/1966 Remington et al.
3,250,323 A 5/1966 Karmazin
3,250,324 A 5/1966 Hicks
3,349,755 A 10/1967 Miller
3,368,546 A 2/1968 Wade
3,457,620 A 7/1969 Ares
3,568,764 A 3/1971 Newman et al.
3,598,402 A 8/1971 Frenzl
3,630,175 A 12/1971 Reid, Jr. et al.
3,734,065 A 5/1973 Reid, Jr. et al.
3,828,575 A 8/1974 Malcosky et al.
3,840,175 A 10/1974 Jacuzzi
3,902,551 A 9/1975 Lim et al.
3,916,989 A 11/1975 Harada et al.
3,966,119 A 6/1976 Harter et al.
3,976,129 A 8/1976 Silver
4,008,732 A 2/1977 Fichter et al.
4,121,583 A 10/1978 Chen
4,147,182 A 4/1979 Akerblom
4,169,502 A 10/1979 Kluck
4,257,479 A 3/1981 Newton
4,266,604 A 5/1981 Sumikawa et al.
4,299,098 A 11/1981 Derosier
D264,500 S 5/1982 Beaton
D265,236 S 6/1982 Yamin
4,361,276 A 11/1982 Paige
4,434,843 A 3/1984 Alford
4,449,581 A 5/1984 Blystone et al.
4,456,059 A 6/1984 Cadars
4,465,128 A 8/1984 Krekacs et al.
4,495,560 A 1/1985 Sugimoto et al.
4,538,418 A 9/1985 Lawrence et al.
4,545,759 A 10/1985 Giles et al.
4,558,571 A 12/1985 Yoshinaga et al.
4,576,223 A 3/1986 Humpolik et al.
4,580,623 A 4/1986 Smitte et al.
4,588,026 A 5/1986 Hapgood
4,592,420 A 6/1986 Hughes
4,595,825 A 6/1986 Gordbegli
4,711,450 A 12/1987 McArthur
4,715,437 A 12/1987 Tanaka et al.
4,735,716 A * 4/1988 Petrucci ..... B01D 27/08 210/500.21
4,738,225 A 4/1988 Juang
4,759,405 A 7/1988 Metzger
4,856,824 A 8/1989 Clausen
4,907,418 A 3/1990 DeFazio
4,923,002 A 5/1990 Haussmann
5,054,774 A 10/1991 Belsito
5,094,224 A 3/1992 Diesch
5,178,211 A 1/1993 Bauer et al.
5,183,449 A 2/1993 DeCloux
5,190,101 A 3/1993 Jalilevand et al.
5,195,673 A 3/1993 Yish et al.
5,201,307 A 4/1993 Afshar
5,216,743 A 6/1993 Seitz
5,222,550 A 6/1993 Griffin et al.
5,228,618 A 7/1993 Afshar
5,318,007 A 6/1994 Afshar
5,318,112 A 6/1994 Gopin
5,470,018 A 11/1995 Smith
5,472,010 A 12/1995 Gonzalez
5,482,115 A 1/1996 Ikeya et al.
5,487,423 A 1/1996 Romero
5,660,230 A 8/1997 Obosu et al.
5,711,369 A 1/1998 Huddleston et al.
5,775,267 A 7/1998 Hou et al.
D397,191 S 8/1998 Kralovec et al.
5,802,864 A 9/1998 Yarbrough et al.
5,901,563 A 5/1999 Yarbrough et al.
5,906,104 A 5/1999 Schwartz et al.
D412,567 S 8/1999 Ward et al.
6,026,804 A 2/2000 Schardt et al.
6,082,993 A 7/2000 O'Leary et al.
6,293,335 B1 9/2001 Tawney et al.
6,295,980 B1 10/2001 Lopez et al.
6,321,833 B1 11/2001 O'Leary et al.
6,436,162 B1 * 8/2002 Wake ..... B01D 46/0004 55/504
6,499,534 B1 12/2002 Tawney et al.
6,755,024 B1 6/2004 Mao et al.
6,793,483 B2 9/2004 Watanabe
6,910,666 B2 6/2005 Burr
6,920,892 B2 7/2005 Agresta et al.
6,994,056 B1 2/2006 Boros
7,063,133 B2 6/2006 Gordon et al.
7,311,740 B2 12/2007 Williams et al.
D574,938 S 8/2008 Martin et al.
7,434,447 B2 10/2008 Deng
7,527,069 B2 5/2009 Denike et al.
7,530,931 B2 5/2009 Amendola et al.
7,540,431 B2 6/2009 Kozdras et al.
7,543,456 B2 6/2009 Sinha et al.
7,607,426 B2 10/2009 Deng
7,654,820 B2 2/2010 Deng
7,677,236 B2 3/2010 Deng
7,730,765 B2 6/2010 Deng
7,814,934 B2 10/2010 Thelen
7,967,006 B2 6/2011 Deng
7,967,007 B2 6/2011 Deng
7,971,603 B2 7/2011 Willis et al.
8,011,920 B2 9/2011 Deng
8,152,515 B2 4/2012 Deng
8,235,708 B2 8/2012 Deng
8,241,034 B2 8/2012 Deng
8,281,781 B2 10/2012 Deng
8,297,968 B2 10/2012 Deng
8,317,511 B2 11/2012 Deng
8,465,277 B2 6/2013 Deng
8,506,290 B2 8/2013 Deng
8,516,878 B2 8/2013 Deng
8,517,718 B2 8/2013 Deng
8,545,216 B2 10/2013 Deng
8,563,180 B2 10/2013 Perry et al.
8,568,136 B2 10/2013 Deng
8,752,541 B2 6/2014 Deng
8,757,139 B2 6/2014 Deng
8,757,202 B2 6/2014 Deng
8,764,436 B2 7/2014 Deng
8,851,065 B2 10/2014 Deng
8,877,399 B2 11/2014 Weingaertner et al.
8,915,239 B2 12/2014 Deng
8,985,094 B2 3/2015 Deng
9,353,998 B2 5/2016 Willis et al.
9,388,976 B2 7/2016 Tilmont et al.
9,464,847 B2 10/2016 Maurer et al.
9,976,819 B2 5/2018 Nibler et al.
11,225,807 B2 1/2022 Corn et al.
2002/0021742 A1 2/2002 Maskell et al.
2002/0157815 A1 10/2002 Sutter
2003/0111840 A1 6/2003 O'Neill et al.
2003/0209345 A1 11/2003 Zweig
2006/0084019 A1 4/2006 Berg et al.
2006/0108435 A1 5/2006 Kozdras et al.
2008/0223561 A1 9/2008 Li et al.
2008/0264617 A1 10/2008 Martin et al.
2010/0101509 A1 4/2010 Tanbour et al.

(56) References Cited

U.S. PATENT DOCUMENTS

| | | | | |
|---|---|---|---|---|
| 2010/0170452 | A1 | 7/2010 | Ford et al. | |
| 2010/0330513 | A1 | 12/2010 | Deng | |
| 2012/0006091 | A1 | 1/2012 | Deng | |
| 2012/0178003 | A1 | 7/2012 | Venkataraman et al. | |
| 2012/0196194 | A1 | 8/2012 | Perry et al. | |
| 2013/0146250 | A1 | 6/2013 | Eller et al. | |
| 2013/0181152 | A1 | 7/2013 | Naumann | |
| 2013/0186492 | A1 | 7/2013 | Deng | |
| 2014/0080078 | A1 | 3/2014 | Albizuri | |
| 2014/0178786 | A1 | 6/2014 | Perry et al. | |
| 2014/0326197 | A1 | 11/2014 | Deivasigamani et al. | |
| 2015/0184855 | A1 | 7/2015 | Kang et al. | |
| 2015/0338099 | A1 | 11/2015 | Deng | |
| 2017/0356691 | A1 | 12/2017 | Willis et al. | |
| 2018/0038592 | A1 | 2/2018 | Willis et al. | |
| 2018/0106498 | A1 | 4/2018 | Nishino et al. | |
| 2019/0293320 | A1 | 9/2019 | Kim | |
| 2020/0032536 | A1 | 1/2020 | Corn et al. | |
| 2020/0378622 | A1* | 12/2020 | Park | F23D 14/64 |
| 2021/0140632 | A1* | 5/2021 | Park | F23D 14/64 |
| 2022/0034503 | A1* | 2/2022 | Ogawa | F24H 1/0027 |

FOREIGN PATENT DOCUMENTS

| | | | | |
|---|---|---|---|---|
| EP | 0067699 | A1 | 12/1982 | |
| EP | 1336736 | A2 | 8/2003 | |
| EP | 1691117 | A1 | 8/2006 | |
| FR | 633229 | A | 1/1928 | |
| FR | 859865 | A | 12/1940 | |
| GB | 332455 | A | 7/1930 | |
| JP | 60-48496 | | 3/1985 | |
| JP | 60-82785 | A | 5/1985 | |
| JP | 60-188796 | A | 9/1985 | |
| JP | 62-175591 | A | 8/1987 | |
| JP | 63-3180 | A | 1/1988 | |
| JP | 2004-137900 | A | 5/2004 | |
| JP | 4229694 | B2 | 2/2009 | |
| SU | 964422 | A2 | 10/1982 | |
| WO | 2006/040053 | | 4/2006 | |
| WO | WO-2012006166 | A2 * | 1/2012 | F23D 14/02 |
| WO | 2017/079104 | A1 | 5/2017 | |

OTHER PUBLICATIONS

Propane 101, Converting Gas Appliances (Year: 2008).*
A. O. Smith Corporation, Brochure for Cyclone Mxi Modulating Water Heater, 2014 (2 pages).
A. O. Smith Corporation, Service Handbook, Commercial Gas High Efficiency Water Heaters, Models BTH 120-500 Series 300/301, Jan. 2017 (54 pages).
Raypak, Inc., Installation & Operating Instructions, X94 Professional Gas-Fired Pool & Spa Heater, Low NOx Model SR-410, dated Jun. 15, 2018 (52 pages).
Raypak, Inc., Replacement Parts Catalog, Model SR-410 X94 Professional, dated Jun. 15, 2016 (8 pages).
Eternal Advanced Hybrid Water Heating, Installation and Operation Manual, 157140081P, dated Jul. 22, 2013 (59 pages).
Pentair MASTERTEMP Pool and Spa Heater, Installation and User's Guide, Rev. M, dated Jan. 8, 2015 (55 pages).
Jandy Pro Series JXi™ Gas-Fired Pool and Spa Heater, Models 200, 260, 400, Installation and Operation Manual, Rev. G, marked @2016 Zodiac Pool Systems, Inc. (48 pages).
Jandy Pro Series JXi™ Pool and Spa Heater, Product Brochure, Rev. F, marked @2017 Zodiac Pool Systems, Inc. (4 pages).
Turbotec Brochure (Prior to Jan. 26, 2006) (6 pages).
MiniMax CH Pool and Spa Heaters, Operation and Installation Manual, Rev. C, dated Jan. 22, 2004, by Pentair Pool Products, Inc. (36 pages) and four photographs (taken prior to Jan. 26, 2007) of a device of the type shown at pp. 7, 11, 19, and A-10 thereof.
MiniMax NTTSI High Performance Natural Gas Heater, Product Brochure, marked @2005 Pentair Water Pool and Spa, Inc. (2 pages).
Raypak Replacement Parts Catalog No. 9100.554, Sep. 16, 2005 (7 pages).
Raypak "Anything But Basic" Catalog No. 6000.12A, Feb. 15, 2005 (4 pages).
Jandy LX/LT Heaters, Product Brochure, Rev. H, marked @2006 Jandy Pool Products, Inc. (2 pages).
Laars LX/LT Low NOx Parts List and Diagram, marked Mfg. 2003-Present (2 pages).
Aars LX and LT Gas-Fired Pool and Spa Heater, Installation and Operation Manual, marked ©Water Pik Technologies 0401 (32 pages).
Reddy Heater Vent-Free Gas Wall Heater Owner's Operation and Installation Manual, Rev. A, Apr. 2015 (32 pages).

* cited by examiner

SWIMMING POOL/SPA GAS HEATER INLET MIXER SYSTEM AND ASSOCIATED METHODS

RELATED APPLICATIONS

This application claims the benefit of priority to U.S. Provisional Patent Application Ser. No. 63/107,380, filed on Oct. 29, 2020, the entire disclosure of which is hereby incorporated by reference.

TECHNICAL FIELD

The present disclosure relates to an inlet mixer system for combustion blowers of swimming pool or spa heaters and associated methods and, in particular, to inlet mixer systems that allow a swimming pool or spa heater to be converted from being configured for use with a first fuel gas to being configured for use with a second fuel gas.

BACKGROUND

Gas heaters for swimming pools generally include a combustion system that can accept a variety of fuel gases, such as natural gas and propane gas. Such gas heaters generally include an inlet that receives fuel gas and air, which are drawn through the inlet and into the combustion system. These gas heaters can also include a gas injection system having a separate orifice that meters the fuel gas provided to the inlet. To convert a gas pool heater from one fuel gas to another, a modification to the gas injection system may be needed. Such modifications can include, for example, changing and/or adding one or more gas injectors or orifices, which can require the use of tools, disassembly of multiple components within the heater, and expertise in the procedure by, e.g., an installer. Due to the complexity of such modifications, swimming pool heater manufacturers generally produce multiple pool heater models preset to different fuel gases to simplify the process of having the installer switch between different fuel gases.

Alternatively, gas heaters can be provided with two gas orifices connectable to different gas sources, and a valve that allows one of the two orifices to be selected by the installer. However, such valves may inadvertently be positioned between a fully open and a fully closed position, thus allowing passage of gas through both the first and second orifices, which can lead to improper gas flow. Excessive gas flow into the gas injection system, e.g., due to improper gas flow, can result in damage to the gas injection system, overheating, and production of excessive and unwanted exhaust emissions, such as carbon monoxide.

Thus, a need exists for robust gas mixing and metering devices that allow a pool or spa heater to be converted between different types of gases without requiring tools, or modifying the gas injection system. These and other needs are addressed by the inlet mixing devices and associated methods of the present disclosure.

SUMMARY OF THE DISCLOSURE

In accordance with embodiments of the present disclosure, an inlet mixer system for a gas heater is provided that includes a housing configured to be secured in fluid communication with an inlet of a combustion blower, a first mixer insert configured to be removably positioned within the housing, and a second mixer insert configured to be removably positioned within the housing. The housing includes a body with a gas inlet disposed therethrough. The first mixer insert can include a body defining a mixing chamber, an air intake, and a first plurality of orifices disposed radially about the body and extending through the body. The first plurality of orifices can be configured to provide a first volumetric flow rate of a first fuel gas. The second mixer insert can include a body defining a mixing chamber, an air intake, and a second plurality of orifices disposed radially about the body and extending through the body. The second plurality of orifices can be configured to provide a second volumetric flow rate of a second fuel gas. When the first mixer insert is positioned within the housing the inlet mixer system is configured for use with the first fuel gas, and when the second mixer insert is positioned within the housing the inlet mixer system is configured for use with the second fuel gas.

In some aspects, when the first mixer insert is positioned within the housing an annular chamber can be formed between the housing and the first mixer insert. The annular chamber can be in fluid communication with the gas inlet of the housing and the mixing chamber of the first mixer insert via the first plurality of orifices. In such aspects, the inlet mixer system can be configured to have the first fuel gas drawn through the gas inlet, into the annular chamber, through the first plurality of orifices, and into the mixing chamber by air drawn through the first mixer insert by the combustion blower.

In other aspects, when the second mixer insert is positioned within the housing an annular chamber can be formed between the housing and the second mixer insert. The annular chamber can be in fluid communication with the gas inlet of the housing and the mixing chamber of the second mixer insert via the second plurality of orifices. In such aspects, the inlet mixer system can be configured to have the second fuel gas drawn through the gas inlet, into the annular chamber, through the second plurality of orifices, and into the mixing chamber by air drawn through the second mixer insert by the combustion blower.

In some aspects, the housing can include one or more locking tabs and the first mixer insert can include one or more reciprocal locking tabs. The locking tabs of the housing can be configured to engage the reciprocal locking tabs of the first mixer insert to removably secure the first mixer insert within the housing. In such aspects, the one or more locking tabs of the housing can be configured to engage the one or more reciprocal locking tabs of the first mixer insert upon rotation of the first mixer insert within the housing.

In some aspects, the housing can include one or more locking tabs and the second mixer insert can include one or more reciprocal locking tabs, such that the one or more locking tabs of the housing are configured to engage the one or more reciprocal locking tabs of the second mixer insert to removably secure the second mixer insert within the housing. In such aspects, the one or more locking tabs of the housing can be configured to engage the one or more reciprocal locking tabs of the second mixer insert upon rotation of the second mixer insert within the housing.

A method of switching a gas heater for a swimming pool or spa from a first configuration for use with a first fuel gas to a second configuration for use with a second fuel gas is provided. The method also involves removing a first mixer insert from a housing secured in fluidic communication with an inlet of a combustion blower. The housing can have a body with a gas inlet disposed therethrough. The first mixer insert can have a body defining a mixing chamber, an air intake, and a first plurality of orifices disposed radially about the body and extending through the body. The first plurality of orifices can be configured to provide a first volumetric flow rate of a first fuel gas. The method also involves positioning a second mixer insert within the housing. The second mixer insert can have a body defining a mixing chamber, an air intake, and a second plurality of orifices disposed radially about the body and extending through body. The second plurality of orifices configured to provide a second volumetric flow rate of a second fuel gas. The method further involves securing the second mixer insert within the housing.

In some aspects, positioning the second mixer insert within the housing can form an annular chamber within the housing, which can be in fluid communication with the gas inlet of the housing and the mixing chamber of the second mixer insert via the second plurality of orifices. In such aspects, the housing and the second mixer insert can be configured to have the second fuel gas drawn through the gas inlet, into the annular chamber, through the second plurality of orifices, and into the mixing chamber by air drawn through the second mixer insert by the combustion blower.

In some aspects, the method can also involve rotating first mixer insert in a first direction to disengage reciprocal locking tabs of the first mixer insert from locking tabs of the housing. In such aspects, the securing step of the method can involve rotating the second mixer insert in a second direction that is opposite the first direction to engage reciprocal locking tabs of the second mixer insert with the locking tabs of the housing.

A gas heater for a swimming pool or spa is provided that includes a cabinet defining an interior, a combustion chamber, a combustion blower, a burner positioned within the combustion chamber that receives combustible gas from the combustion blower and dissipates the combustible gas, and an inlet mixer. The inlet mixer includes a housing configured to be secured in fluid communication with an inlet of a combustion blower, a first mixer insert configured to be removably positioned within the housing, and a second mixer insert configured to be removably positioned within the housing. The housing includes a body with a gas inlet disposed therethrough. The first mixer insert can include a body defining a mixing chamber, an air intake, and a first plurality of orifices disposed radially about the body and extending through the body. The first plurality of orifices can be configured to provide a first volumetric flow rate of a first fuel gas. The second mixer insert can include a body defining a mixing chamber, an air intake, and a second plurality of orifices disposed radially about the body and extending through the body. The second plurality of orifices can be configured to provide a second volumetric flow rate of a second fuel gas. When the first mixer insert is positioned within the housing the inlet mixer system is configured for use with the first fuel gas, and when the second mixer insert is positioned within the housing the inlet mixer system is configured for use with the second fuel gas. The combustion chamber, the burner, the combustion blower, and the inlet mixer are positioned within the interior of the cabinet.

In some aspects, when the first mixer insert is positioned within the housing an annular chamber can be formed between the housing and the first mixer insert. The annular chamber can be in fluid communication with the gas inlet of the housing and the mixing chamber of the first mixer insert via the first plurality of orifices. In such aspects, the inlet mixer system can be configured to have the first fuel gas drawn through the gas inlet, into the annular chamber, through the first plurality of orifices, and into the mixing chamber by air drawn through the first mixer insert by the combustion blower.

In other aspects, when the second mixer insert is positioned within the housing an annular chamber can be formed between the housing and the second mixer insert. The annular chamber can be in fluid communication with the gas inlet of the housing and the mixing chamber of the second mixer insert via the second plurality of orifices. In such aspects, the inlet mixer system can be configured to have the second fuel gas drawn through the gas inlet, into the annular chamber, through the second plurality of orifices, and into the mixing chamber by air drawn through the second mixer insert by the combustion blower.

In some aspects, the housing can include one or more locking tabs and the first mixer insert can include one or more reciprocal locking tabs. The locking tabs of the housing can be configured to engage the reciprocal locking tabs of the first mixer insert to removably secure the first mixer insert within the housing. In such aspects, the one or more locking tabs of the housing can be configured to engage the one or more reciprocal locking tabs of the first mixer insert upon rotation of the first mixer insert within the housing.

In other aspects, the housing can include one or more locking tabs and the second mixer insert can include one or more reciprocal locking tabs, such that the one or more locking tabs of the housing are configured to engage the one or more reciprocal locking tabs of the second mixer insert to removably secure the second mixer insert within the housing. In such aspects, the one or more locking tabs of the housing can be configured to engage the one or more reciprocal locking tabs of the second mixer insert upon rotation of the second mixer insert within the housing.

An inlet mixer kit for a pool swimming pool or spa gas heater includes a housing that is removably securable in fluid communication with an inlet of a combustion blower, a first mixer insert that is removably positionable within the housing, and a second mixer insert that is removably positionable within the housing. The housing includes a body with a gas inlet disposed therethrough. The first mixer insert includes a body defining a mixing chamber, an air intake, and a first plurality of orifices disposed radially about the body and extending through the body. The first plurality of orifices are configured to provide a first volumetric flow rate of a first fuel gas. The second mixer insert includes a body defining a mixing chamber, an air intake, and a second plurality of orifices disposed radially about the body and extending through the body. The second plurality of orifices are configured to provide a second volumetric flow rate of a second fuel gas. When the first mixer insert is positioned within the housing the inlet mixer system is configured for use with the first fuel gas, and when the second mixer insert is positioned within the housing the inlet mixer system is configured for use with the second fuel gas.

In some aspects, when the first mixer insert is positioned within the housing an annular chamber can be formed between the housing and the first mixer insert. The annular chamber can be in fluid communication with the gas inlet of the housing and the mixing chamber of the first mixer insert via the first plurality of orifices. In such aspects, the inlet mixer system can be configured to have the first fuel gas drawn through the gas inlet, into the annular chamber, through the first plurality of orifices, and into the mixing chamber by air drawn through the first mixer insert by the combustion blower.

In other aspects, when the second mixer insert is positioned within the housing an annular chamber can be formed between the housing and the second mixer insert. The annular chamber can be in fluid communication with the gas inlet of the housing and the mixing chamber of the second mixer insert via the second plurality of orifices. In such aspects, the inlet mixer system can be configured to have the second fuel gas drawn through the gas inlet, into the annular chamber, through the second plurality of orifices, and into the mixing chamber by air drawn through the second mixer insert by the combustion blower.

In some aspects, the housing can include one or more locking tabs and the first mixer insert can include one or more reciprocal locking tabs. The locking tabs of the housing can be configured to engage the reciprocal locking tabs of the first mixer insert to removably secure the first mixer insert within the housing. In such aspects, the one or more locking tabs of the housing can be configured to engage the one or more reciprocal locking tabs of the first mixer insert upon rotation of the first mixer insert within the housing.

In some aspects, the housing can include one or more locking tabs and the second mixer insert can include one or more reciprocal locking tabs, such that the one or more locking tabs of the housing are configured to engage the one or more reciprocal locking tabs of the second mixer insert to removably secure the second mixer insert within the housing. In such aspects, the one or more locking tabs of the housing can be configured to engage the one or more reciprocal locking tabs of the second mixer insert upon rotation of the second mixer insert within the housing.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed heater inlet mixer system and associated methods, reference is made to the accompanying figures, wherein.

DETAILED DESCRIPTION

In accordance with aspects of the present disclosure, exemplary pool or spa heater inlet mixer systems and methods are provided that allow a pool or spa heater to be converted for use with a first fuel gas to a second fuel gas without the use of tools and without requiring the disassembly of the gas train of the pool or spa heater.

Figure 1:
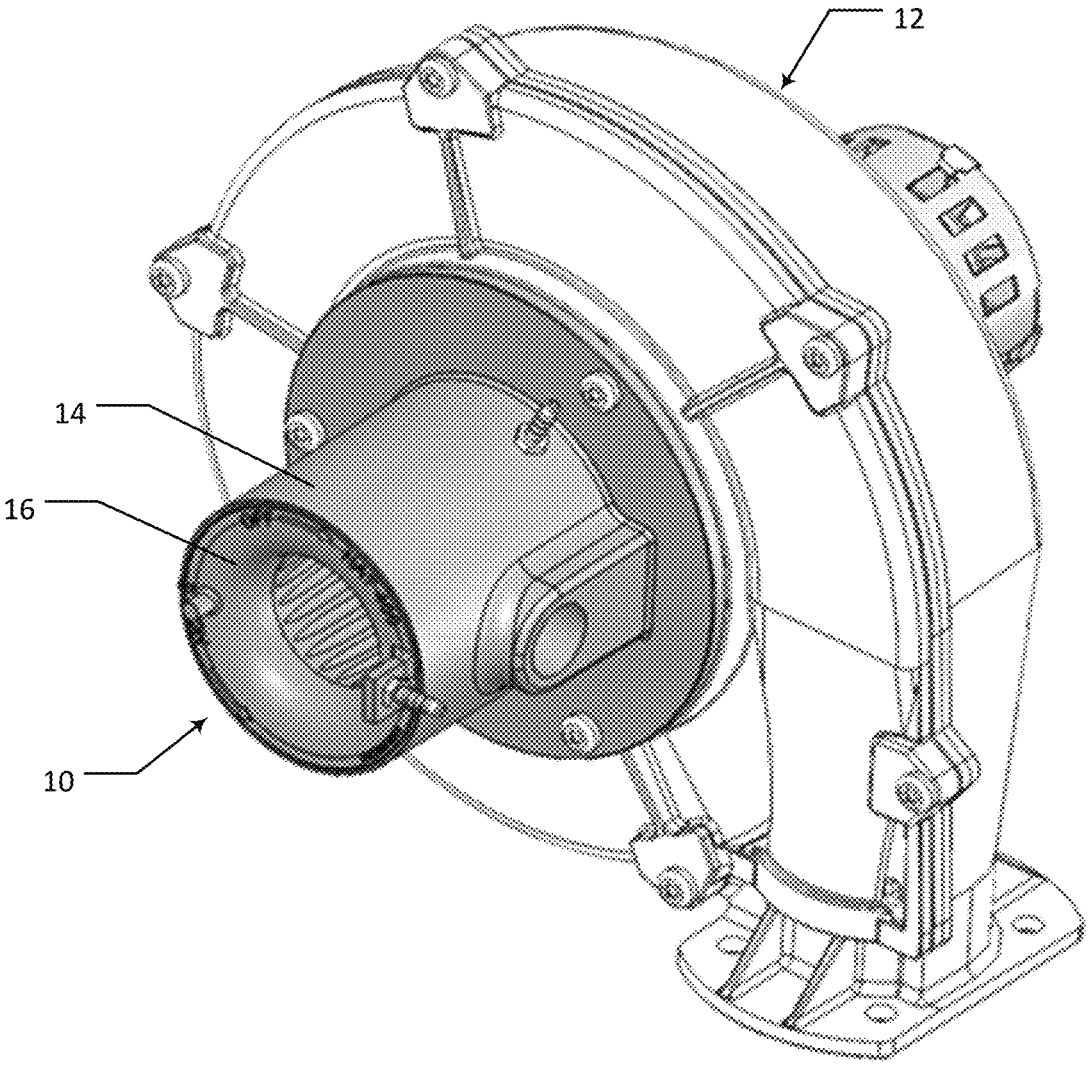
FIG. 1 is a perspective view of an exemplary inlet mixer system coupled to a combustion blower in accordance with embodiments of the present disclosure.
Figure 2:
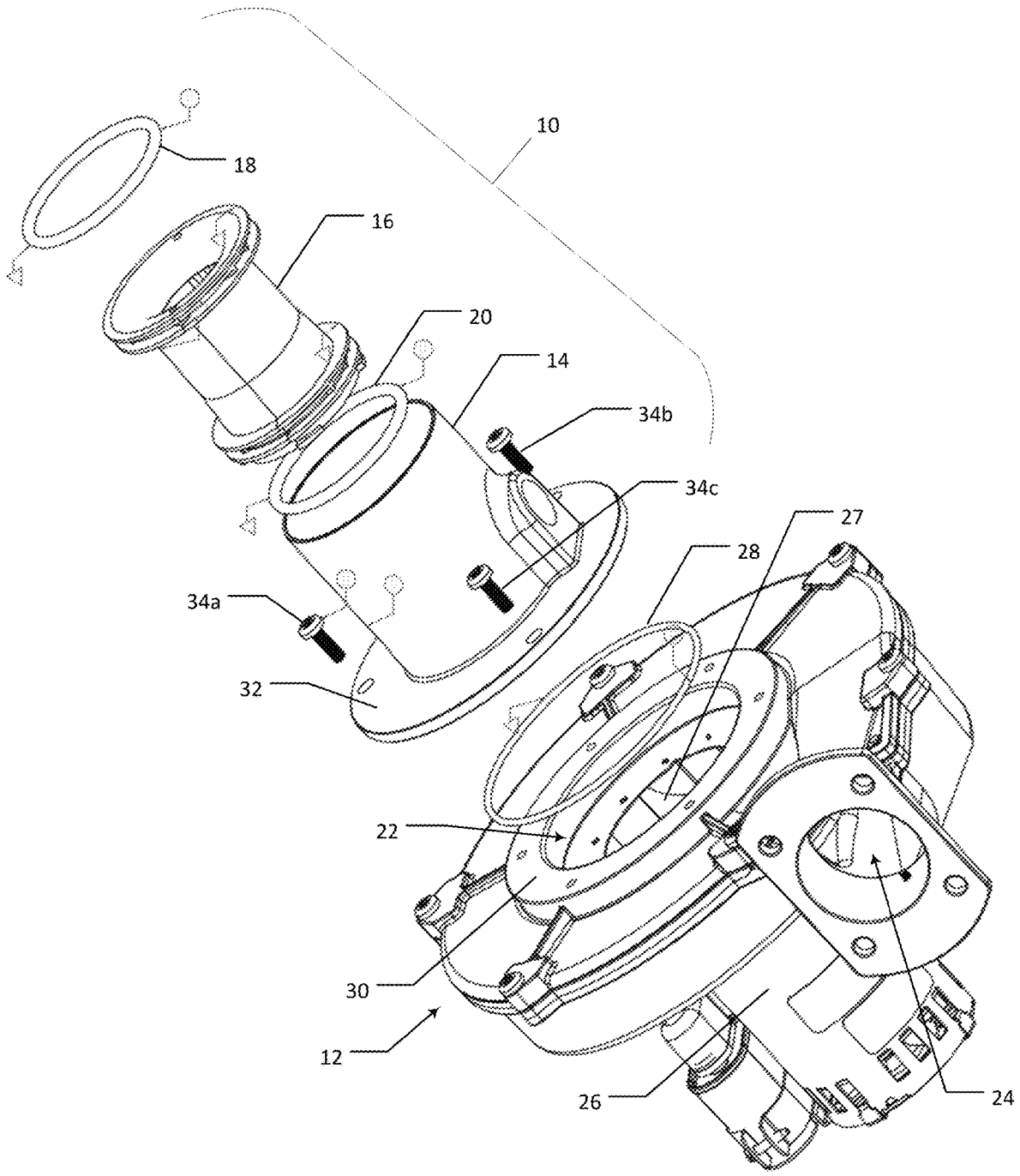
FIG. 2 is an exploded perspective view of the inlet mixer system and combustion blower of FIG. 1.

In accordance with embodiments of the present disclosure, FIG. 1 is a perspective view of an exemplary inlet mixer system 10, also referred to herein as inlet mixer 10, coupled to a combustion blower 12 of a pool or spa heater, and FIG. 2 is an exploded perspective view of the inlet mixer 10 and combustion blower 12.

The inlet mixer 10 includes an inlet housing 14, a mixer insert 16 removably positioned within the inlet housing 14, and a first O-ring 18 and second O-ring 20 disposed there between. The inlet mixer 10 is connectible to the combustion blower 12 and provides a combustible mixture of air and gas to the combustion blower 12, as described in greater detail below. The combustion blower 12 includes a blower inlet 22 that is coupled to the inlet mixer 10, a blower outlet 24 that is coupled to a burner of a pool or spa heater (see, e.g., FIG. 13), a motor 26, and an impeller 27. The motor 26 is configured to rotate the impeller 27, which draws the combustible mixture of air and gas through the inlet mixer 10 and discharges the air/gas mixture into the burner of the pool or spa heater for combustion. A third O-ring 28 can be positioned between an annular face 30 that is adjacent to the blower inlet 22 of the combustion blower 12 and an annular flange 32 of the inlet housing 14. A plurality of fasteners 34*a-c* (e.g., bolts, screws, etc.) can secure the inlet mixer 10 to the combustion blower 12 with the annular flange 32 against the annular face 30, and the third O-ring 28 positioned there between and providing a seal between the inlet mixer 10 and the combustion blower 12.

Figure 3:
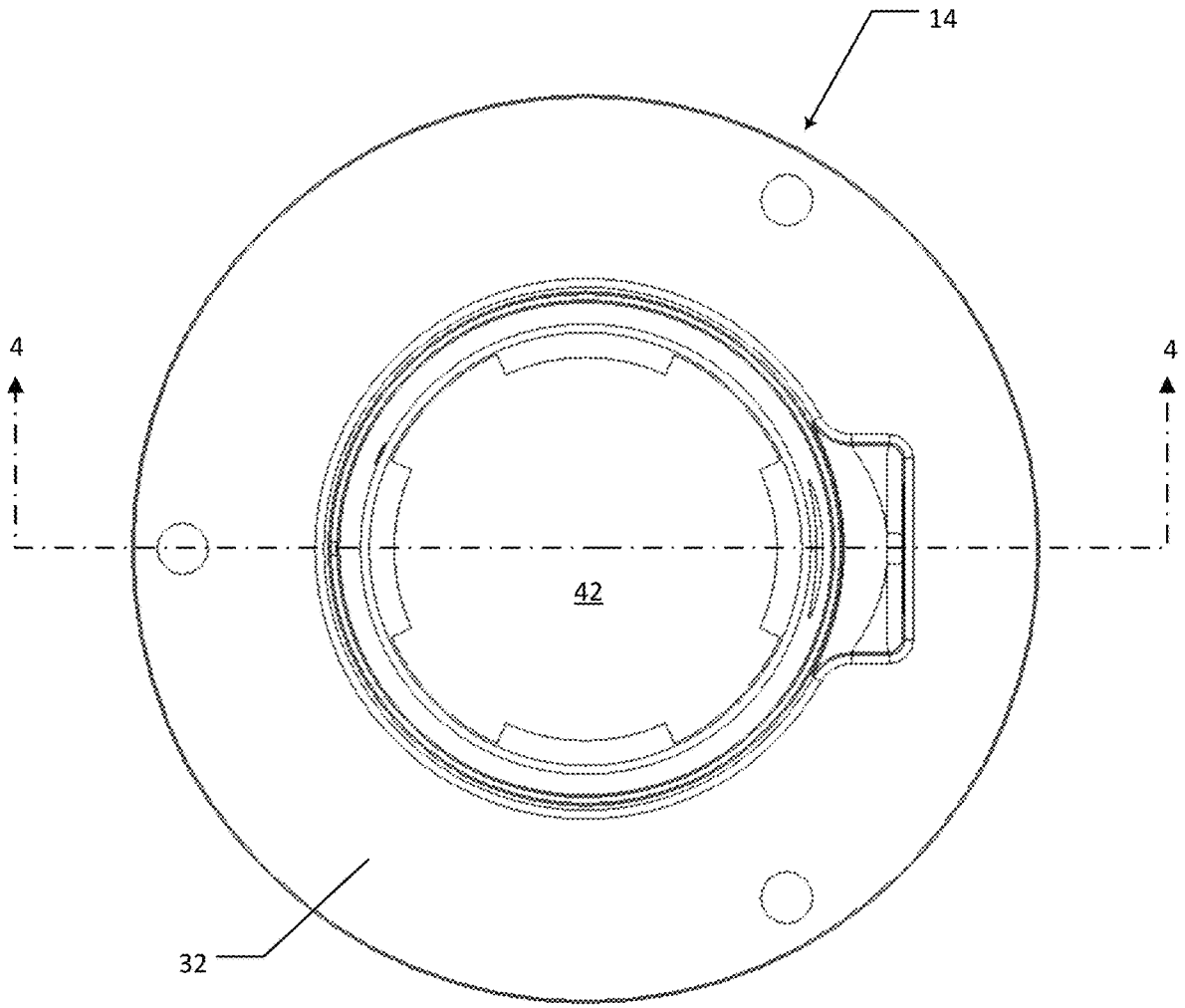
FIG. 3 is a front elevational view of an inlet housing of the inlet mixer system of FIG. 1.
Figure 4:
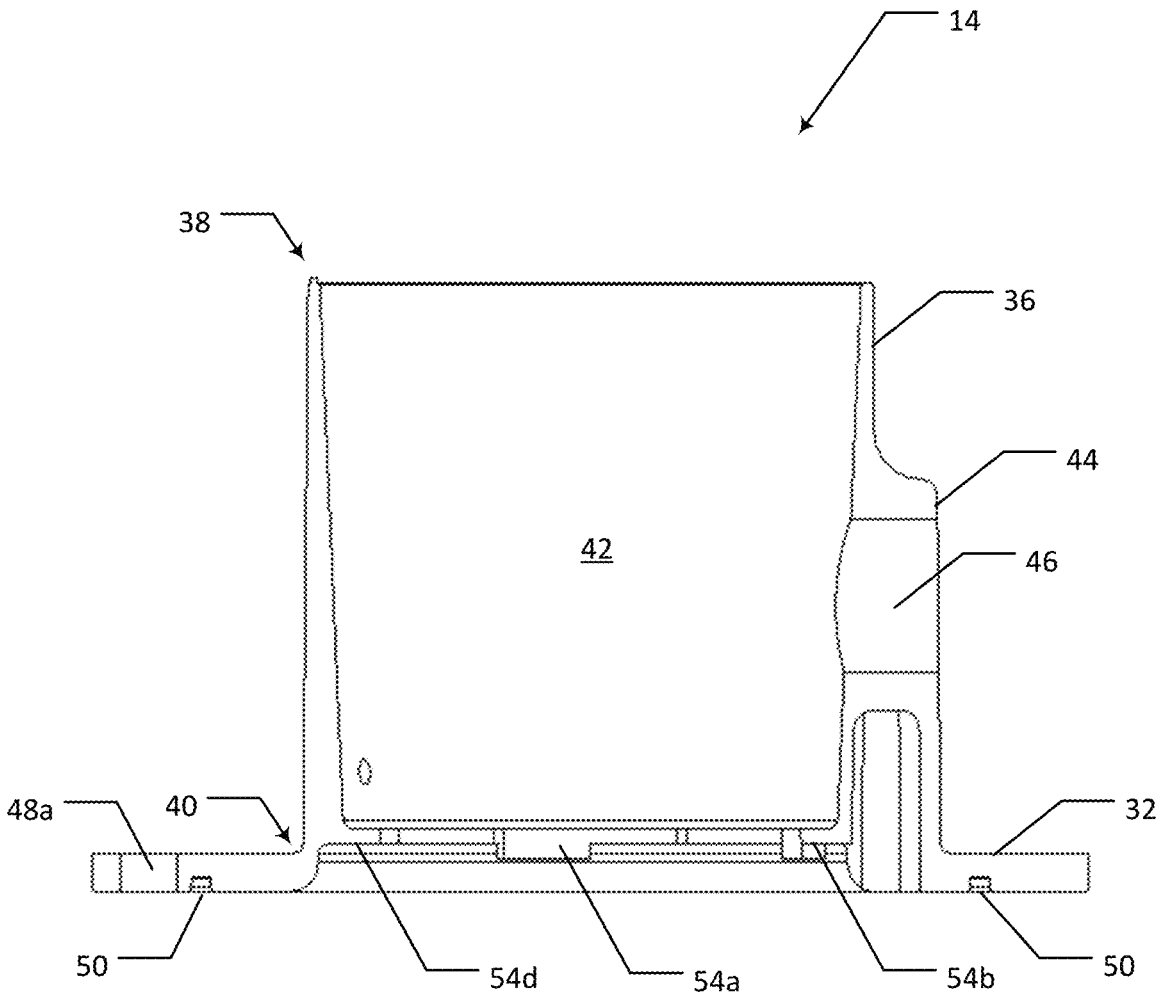
FIG. 4 is a cross-sectional view of the inlet housing of FIG. 3 taken along Line 4-4.
Figure 5:
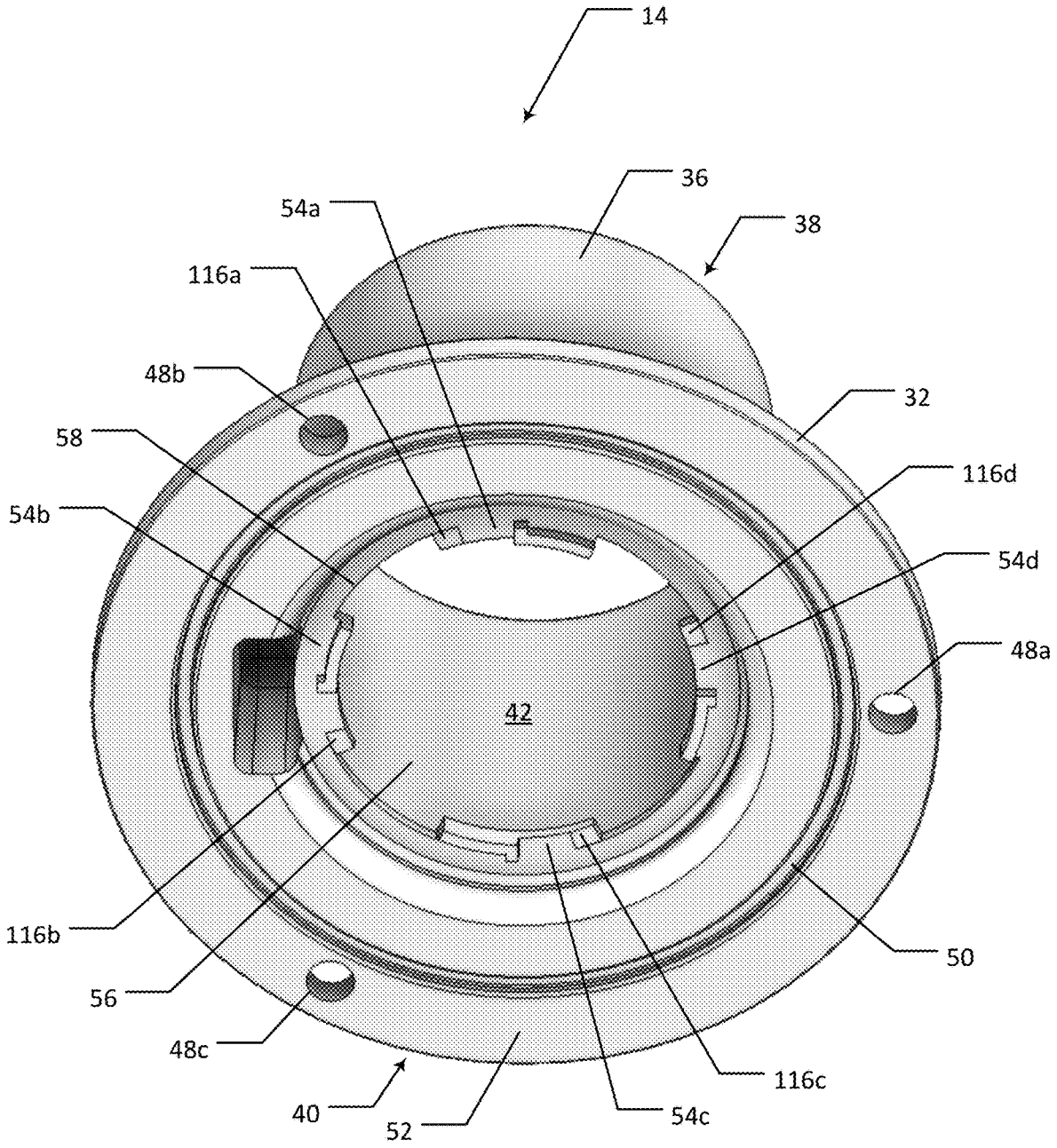
FIG. 5 is a perspective view of the inlet housing of FIG. 3.

FIGS. 3-5 illustrate the inlet housing 14 of the inlet mixer 10 in greater detail. More specifically, FIG. 3 is a front elevational view of the inlet housing 14, FIG. 4 is a cross-sectional view of the inlet housing 14 taken along Line 4-4 of FIG. 3, and FIG. 5 is a perspective view of the inlet housing 14 of the inlet mixer system 10.

The inlet housing 14 can have a substantially cylindrical configuration and include annular wall 36 defining a central chamber 42 extending between a proximal end 38 and a distal end 40 thereof. In some aspects, the inlet housing 14 can gradually taper with the diameter of the proximal end 38 being smaller than the diameter of the distal end 40. The annular flange 32 can extend around the perimeter of the distal end 40 of the annular wall 36, and, as described above, can be used to mount the inlet housing 14 to the combustion blower 12 or other surrounding structures or equipment. As such, the annular flange 32 can include one or more apertures 48*a-c* for receiving the fasteners 34*a-c*, described herein. The annular flange 32 can also include an annular channel 50 on a surface 52 thereof that is configured to be placed adjacent to the annular face 30 of the combustion blower 12. The annular channel 50 can be sized to receive the third O-ring 28, and prevent lateral displacement of the O-ring 28 when the inlet housing 14 is secured to the combustion blower 12.

The annular wall 36 of the inlet housing 14 includes a gas inlet 44 that defines a passage 46 extending through the annular wall 36 and into the central chamber 42. The gas inlet 44 can be coupled to a gas line (see, e.g., FIG. 13), such that gas flowing through the gas line can travel through the passage 46 and into the central chamber 42.

As shown in FIGS. 4 and 5, the inlet housing 14 can include one or more locking tabs 54*a-d* positioned at the distal end 40 of the inlet housing 14. The locking tabs 54*a-d* can be disposed on an interior surface 56 of the annular wall 36 extending radially inward toward the center of the chamber 42, and radially spaced about the circumference of the interior surface 56. According to some aspects, the locking tabs 54*a-d* can extend from an interior flange 58 disposed about the circumference of the interior surface 56 of the inlet housing 14. As described in greater detail in connection with FIGS. 10 and 11, the locking tabs 54*a-d* can engage reciprocal locking tabs 104*a-d* on the mixer insert 16 to removably secure the mixer insert 16 within the inlet housing 14 without the need for tools.

Figure 6:
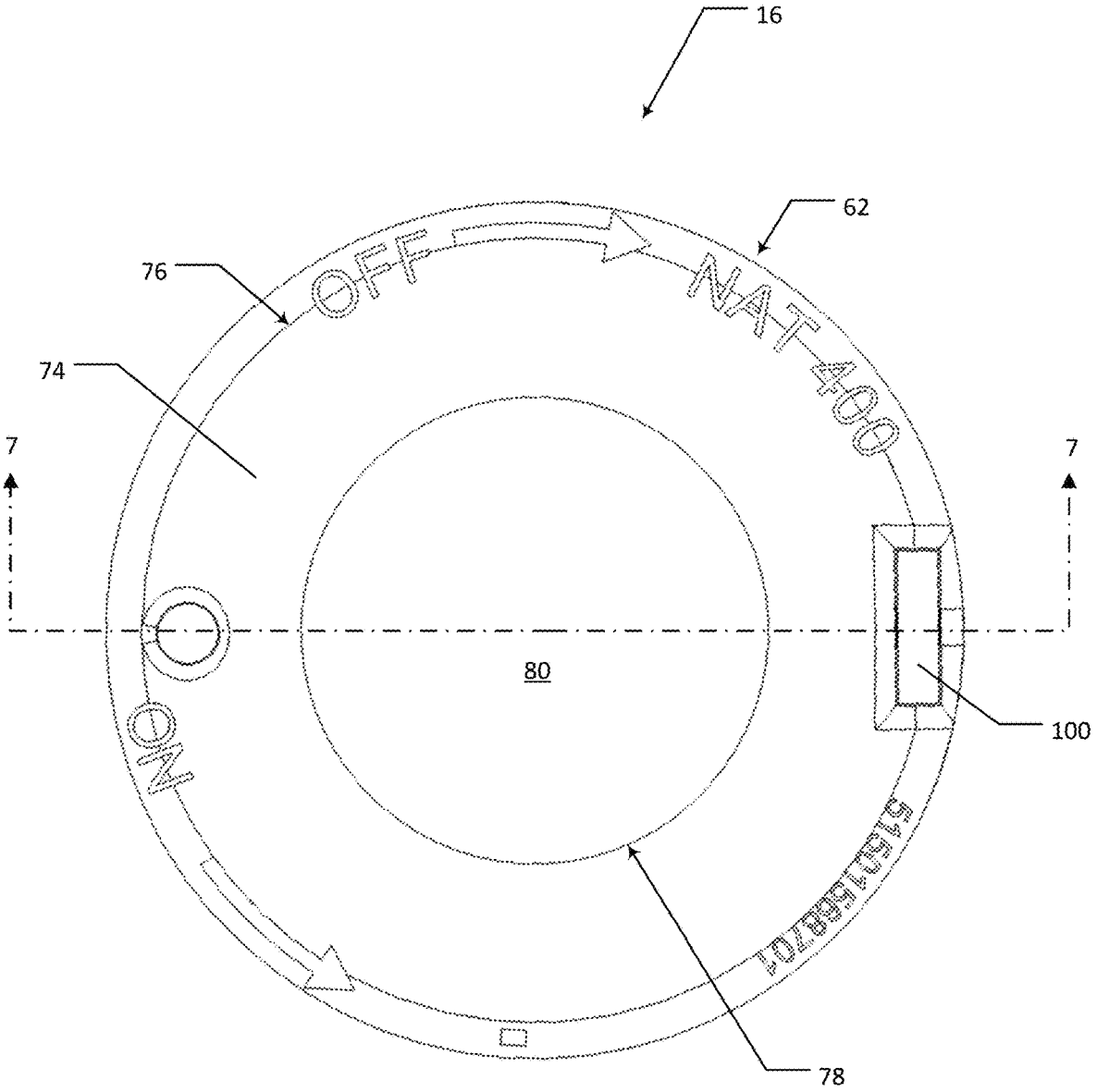
FIG. 6 is a front elevational view of a mixer insert of the inlet mixer system of FIG. 1.
Figure 7:
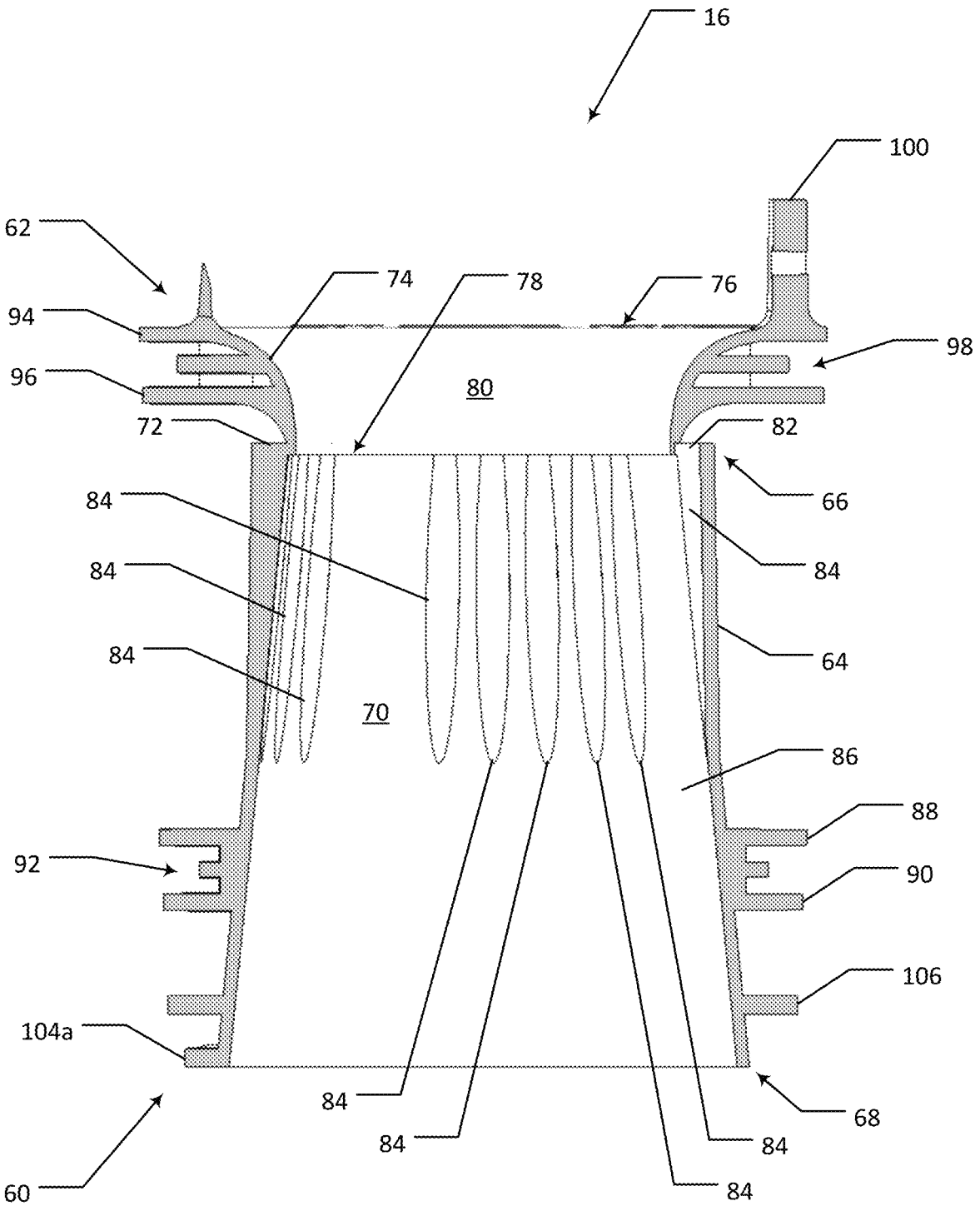
FIG. 7 is a cross-sectional view of the mixer insert of FIG. 6 taken along Line 7-7.
Figure 8:
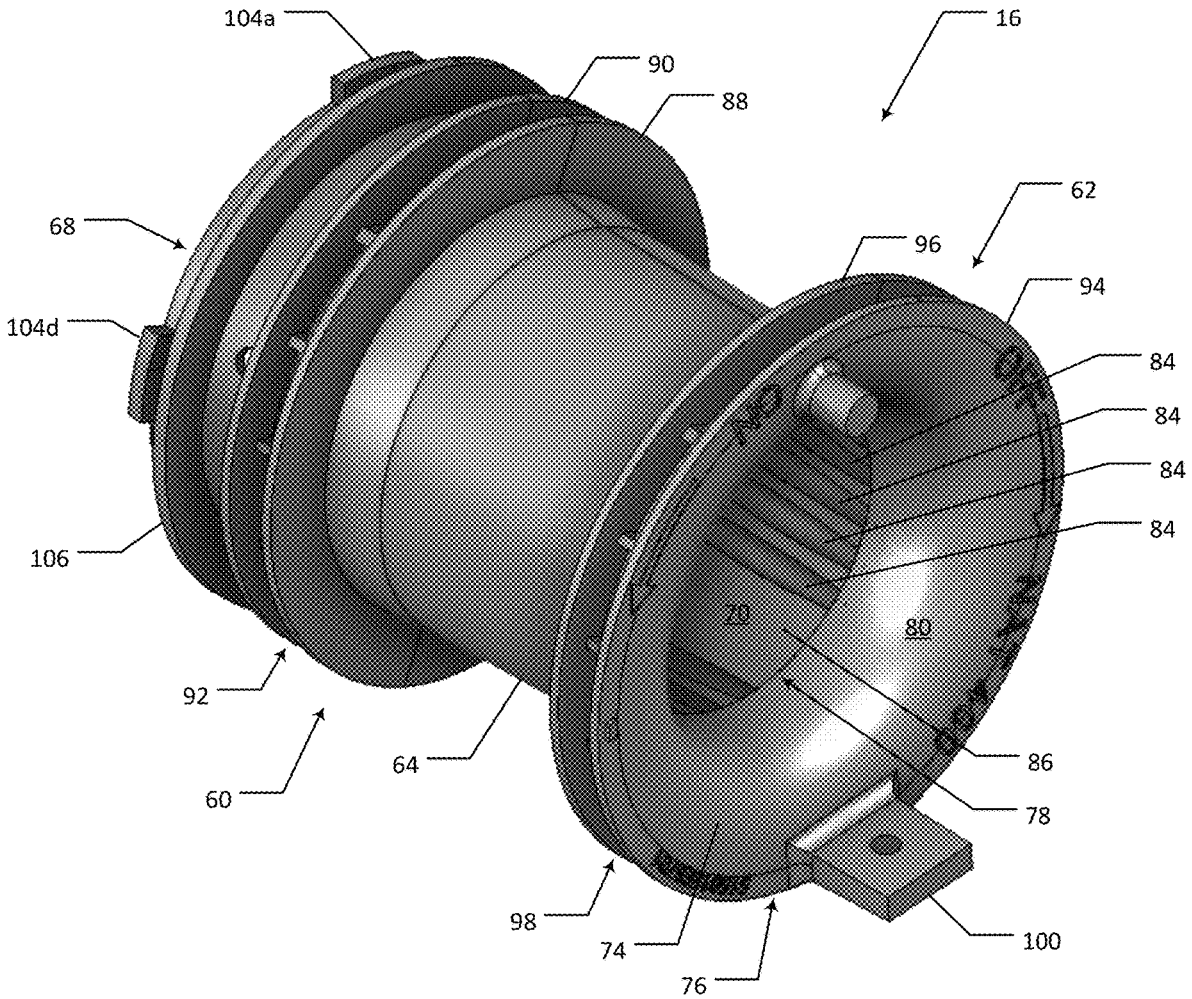
FIG. 8 is a first perspective view of the mixer insert of FIG. 6.
Figure 9:
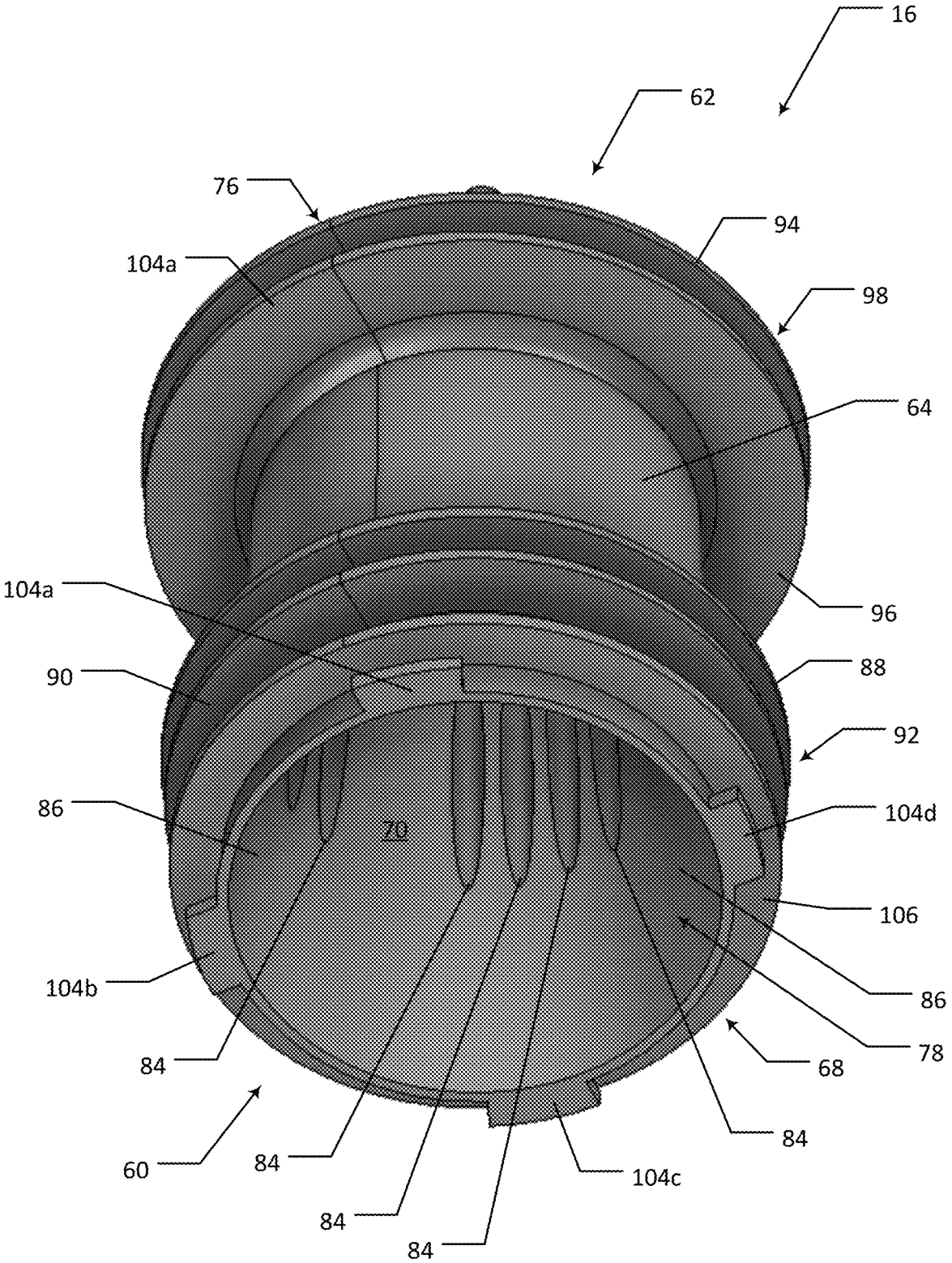
FIG. 9 is a second perspective view of the mixer insert of FIG. 6.

FIGS. 6-9 illustrate the mixer insert 16 of the inlet mixer 10 in greater detail. More specifically, FIG. 6 is a front elevational view of the mixer insert 16, FIG. 7 is a cross-sectional view of the mixer insert 16 taken along Line 7-7 of FIG. 6, FIG. 8 is a first perspective view of the mixer insert 16, and FIG. 9 is a second perspective view of the mixer insert 16.

The mixer insert 16 includes a body 60 and an air funnel 62. The body 60 can have a substantially cylindrical configuration with an annular wall 64 defining a mixing chamber 70 extending between a proximal end 66 and a distal end 68 of the annular wall 64. The body 60 can gradually taper radially outward from the proximal end 66 to the distal end 68 such that the diameter of the proximal end 66 is smaller than the diameter of the distal end 68.

An interior flange 72 can extend from the proximal end 66 of the body 60 radially inward into the mixing chamber 70. A plurality of orifices 82 are positioned radially about the interior flange 72 and extend through the interior flange 72 into the mixing chamber 70. The orifices 82 can be sized to allow a specific amount of fuel gas to be drawn from the central chamber 42 of the inlet housing 14 into the mixing chamber 70 and, ultimately, into the burner of a pool or spa heater. Additionally, a plurality of vertical channels 84 can be radially disposed about an interior surface 86 of the body 60 and connect to the plurality of orifices 82. For example, as shown in FIG. 7, the channels 84 can extend from the orifices 82 along at least a portion of the length of the annular wall 64 and can have cross-sectional areas that are dependent on the diameters of the orifices 82. It should be understood that the number, size, and spacing of the orifices 82 can vary depending on the inlet gas being used and requirements of the gas heater that it is configured for use with.

The air funnel 62 can include a conically shaped interior surface 74 having a proximal opening 76 with a greater diameter than a distal opening 78, and defining an air inlet chamber 80 of the inlet mixer 10. As shown in FIG. 7, the interior surface 74 at the distal opening 78 of the funnel 62 can coincide and connect with an inner diameter of the interior flange 72 of the body 60, thereby providing a connection point between the body 60 and the funnel 62. The mixer insert 16 can also include a mount 100 positioned at the proximal opening 76 of the funnel 62 for securing a reference pressure tap 102 (see FIG. 11) at the air inlet 80 of the mixer insert 16, such that a control system of a pool or spa heater can monitor the air pressure at the air inlet 80.

Additionally, the mixer insert 16 can include a plurality of exterior flanges 88, 90, 94, 96, e.g., four, that are sized and positioned to accept the first O-ring 18 and the second O-ring 20. For example, the first exterior flange 88 and the second exterior flange 90 can define a first radial channel 92 about the body 60 of the mixer insert 16 that is sized to accept the second O-ring 20. Similarly, the third exterior flange 94 and the fourth exterior flange 96 can define a second radial channel 98 about the air funnel 62 of the mixer insert 16 that is sized to accept the first O-ring 18.

As shown in FIG. 9, the mixer insert 16 can include one or more locking tabs 104*a-d* positioned at the distal end 68 of the mixer insert 16, and a fifth annular flange 106 positioned thereabove. The locking tabs 104*a-d* can be disposed radially about the circumference of the annular wall 64 and can extend radially outward therefrom. As shown in, and described in connection with, FIGS. 10 and 11, the locking tabs 104*a-d* and annular flange 106 can engage the reciprocal locking tabs 54*a-d* on the inlet housing 14 to removably secure the mixer insert 16 within the inlet housing 14.

It should be understood that first and second mixer inserts 16 can be provided and interchanged. In particular, the first and second mixer inserts 16 can be substantially similar in form and function, but for the number, configuration, or size of the orifices 82, and can be swapped depending on the gas source being utilized.

For example, the first mixer insert 16 can include orifices 82 that can be sized or calibrated for passage of a first type of gas, e.g., propane gas. Similarly, the diameter of the orifices 82 of the second mixer insert 16 can be sized or calibrated for passage of a second type of gas, e.g., natural gas. Accordingly, when a gas injection system of a pool or spa heater is using propane gas, the first mixer insert 16 can be positioned within the inlet housing 14, the orifices 82 of the first mixer insert 16 being dimensioned and numbered for proper flow of the propane gas. Likewise, when the gas injection system is using natural gas, the second mixer insert 16 can be positioned within the inlet housing 14, the orifices 82 of the second mixer insert 16 being dimensioned and numbered for proper flow of the natural gas. Furthermore, additional mixer inserts can be provided having orifices of other sizes if gases other than propane gas and natural gas are to be used.

Sizing or calibration of the orifices 82 for natural gas and propane (or any fuel gas) can be based on the heating value or heat content of the fuel gas. Heating value units can be in energy per unit volume, such as Btu per cubic foot (CF). In general, natural gas (e.g., methane gas) has a heating value of approximately 1,000 Btu/CF, and propane gas has a heating value of approximately 2,500 Btu/CF. For example, if generation of 250,000 Btu per hour of heat energy is desired from combustion of a fuel gas, approximately 100 CF of propane gas should be burned per hour or 250 CF of natural gas per hour. Thus, different volumetric flow rates are needed for each type of gas. The different volumetric flow rates of the types of gases being used can be considered when sizing the gas orifices 82. For example, the injection pressure (regulated by a pressure regulator in a gas control valve), the specific gravity of the gas, the heating value of the gas, and the desired heat output rate can all be considered. Additionally, a "K" factor, which varies depending on the orifice geometry, can be taken into account. The foregoing can be considered in determining the number and size of orifices 82 based on the fuel gas used therewith.

Figure 10:
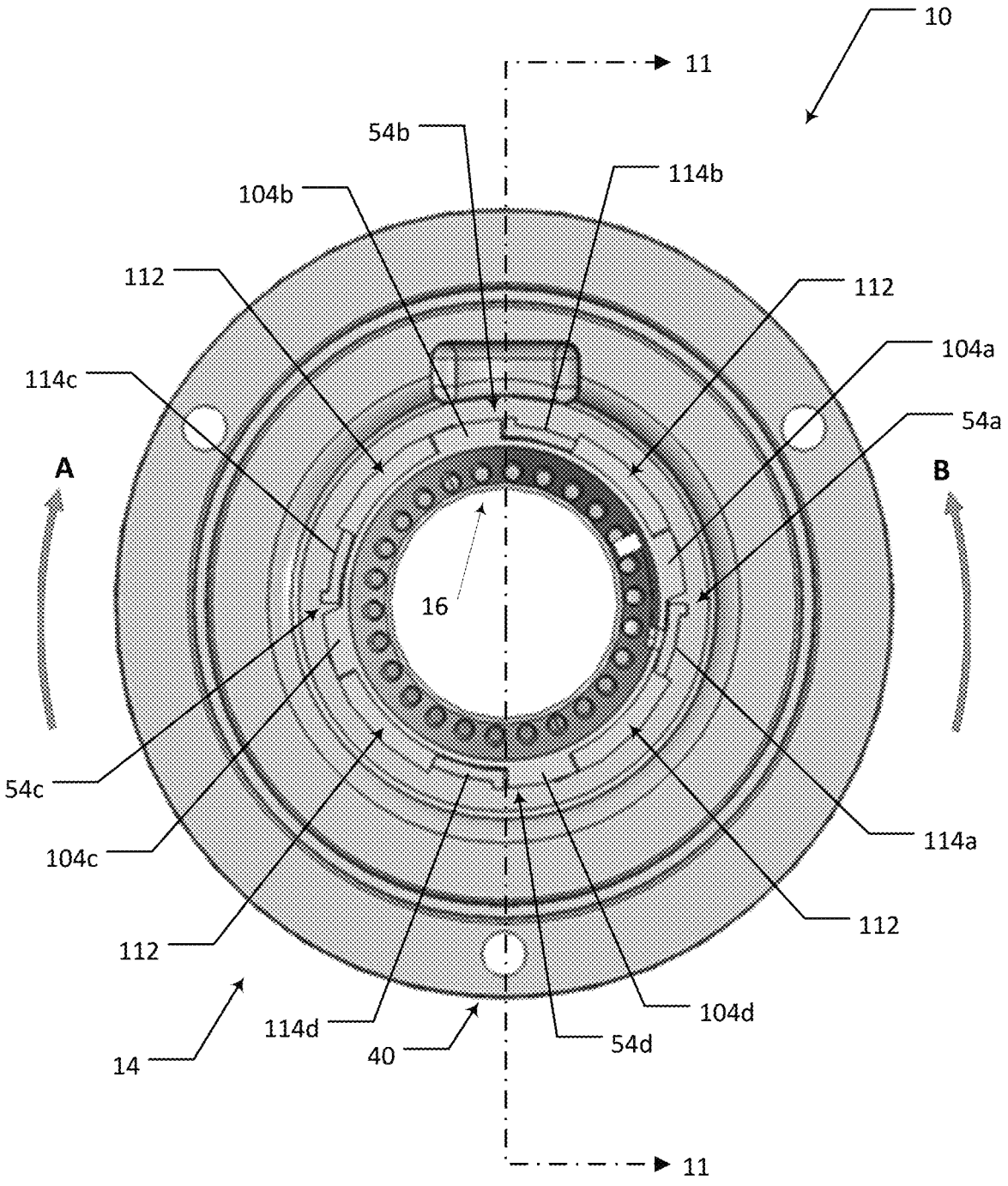
FIG. 10 is a rear view of the inlet mixer system of FIG. 1.
Figure 11:
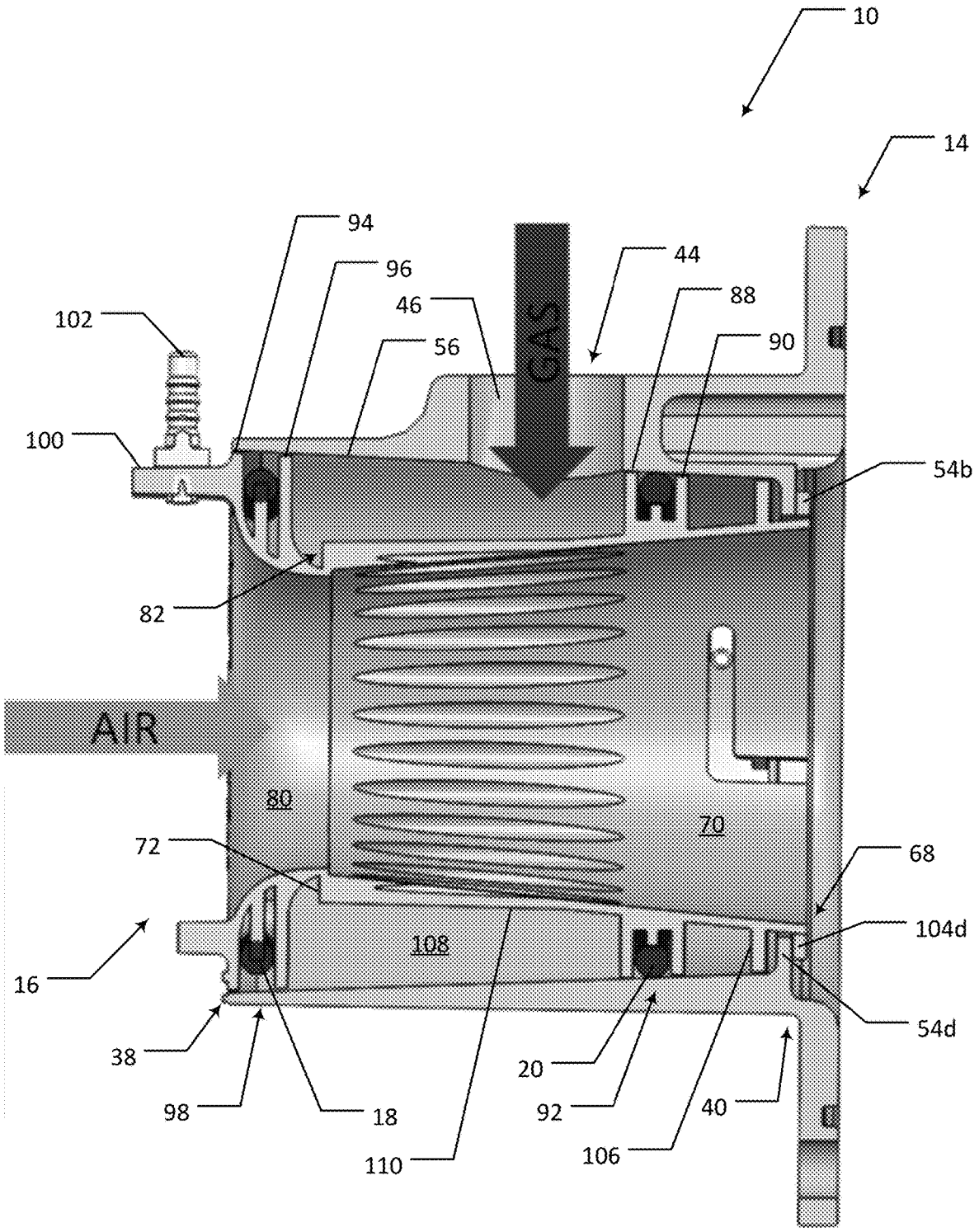
FIG. 11 is a cross-sectional view of the inlet mixer system of FIG. 10 taken along line 11-11.

FIG. 10 is a rear elevational view of the inlet mixer system 10 in an assembled configuration, and FIG. 11 is a cross-sectional view of the inlet mixer 10 taken along Line 11-11 of FIG. 10. As shown, the first flange 88, second flange 90, third flange 94, fourth flange 96, and fifth flange 106 of the mixer insert 16 are configured to have exterior diameters that are substantially equal to the diameter of the interior surface 56 of the inlet housing 14. The third flange 94 and fourth flange 96 of the mixer insert 16 are positioned at the proximal end 38 of the inlet housing 14 with the first O-ring 18 positioned within the second radial channel 98, thereby forming a seal between the mixer insert 16 and the inlet housing 14 proximate to the air inlet 80. Similarly, the first flange 88 and second flange 90 of the mixer insert 16 are positioned below the gas inlet 44 and passage 46 with the second O-ring 20 positioned within the first radial channel 92, thereby forming a seal between the mixer insert 16 and the inlet housing 14. Accordingly, a sealed annular chamber 108 is formed between the inlet housing 14 and the mixer insert 16, which is defined by the interior surface 56 of the inlet housing 14, an exterior surface 110 of the mixer insert 16, the first flange 88, and the fourth flange 96. Furthermore, the annular chamber 108 is in communication with the passage 46 of the gas inlet 44 and is also in communication with the mixing chamber 70 of the mixer insert 14 via the orifices 82 (see, e.g., FIG. 7) that extend through the interior flange 72.

As such, gas can enter the inlet mixer 10 through the inlet 44, flow through the passage 46 and into the annular chamber 108, and pass through the orifices 82 into the mixing chamber 70 of the mixer insert 16, where the gas is mixed with air drawn through the air inlet 80 by the combustion blower 12. The combustible mixture of gas and air is drawn through the inlet mixer 10, exits through the opening at the distal end 68 thereof, and flows into the inlet 22 of the combustion blower 12, from which the gas is finally expelled into the burner of the heater where it is discharged into a combustion chamber and ignited to heat pool or spa water.

As shown in FIGS. 10 and 11, the mixer insert 16 can be removably secured within the inlet housing 14. More specifically, the locking tabs 104*a-d* and the radial flange 106 positioned at the distal end 68 of the mixer insert 16 can rotatably engage the reciprocal locking tabs 54*a-d* positioned at the distal end 40 of the inlet housing 14. For example, in order to engage the mixer insert 16 with the inlet housing 14, the distal end 68 of the mixer insert 16 is inserted through the proximal end 38 of the inlet housing 14 and axially rotated such that the locking tabs 104*a-d* of the mixer insert can pass through spaces 112 between the locking tabs 54*a-d* of the inlet housing 14. As shown best in FIG. 11, the annular flange 106 of the mixer insert can contact the locking tabs 54*a-d* of the inlet housing 14, thereby preventing the mixer insert 16 from passing through the inlet housing 14 and into the inlet 22 of the combustion blower 12. Once the mixer insert 16 has been fully inserted, the mixer insert 16 can be rotated about its central longitudinal axis, e.g., in the direction of arrow A, such that the locking tabs 104*a-d* overlap and engage the corresponding locking tabs 54*a-d* of the inlet housing 14, thereby securing the mixer insert 16 within the inlet housing 14 and preventing vertical movement thereof. Thus, the mixer insert 16 can be toollessly engaged with the inlet housing 14. In order to disengage the mixer insert 16 from the inlet housing 14, the foregoing steps are reversed, e.g., by rotating the mixer insert 16 in the direction of arrow B and withdrawing the mixer insert 16 from the proximal end 38 of the inlet housing 14. For example, this can be done to remove and replace the mixer insert 16, e.g., with a different mixer insert 16.

According to some embodiments of the present disclosure, the locking tabs 54*a-d* can be provided with detents 114*a-d* that prevent further rotational movement of the mixer insert 16, once the locking tabs 104*a-d* have been fully engaged. Additionally, the locking tabs 54*a-d* can be provided with ramped portions 116*a-d* (see, e.g., FIG. 5) that allow the locking tabs 104*a-d* of the mixer insert 16 to more easily engage the locking tabs 54*a-d* of the inlet housing 14.

Accordingly, a first mixer insert 16 of the present disclosure configured for use with a first fuel gas can be easily removed from the inlet housing 14 and replaced with a second mixer insert 16 configured for use with a second fuel gas, thereby converting a pool or spa heater for use with the first fuel gas to the second fuel gas without the need for tools or disassembly of the gas train. Another advantage of the inlet mixer 10 is that it allows a pool heater to leave the factory with all necessary components to function with one or more approved fuel gases, e.g., natural gas and propane.

Figure 12:
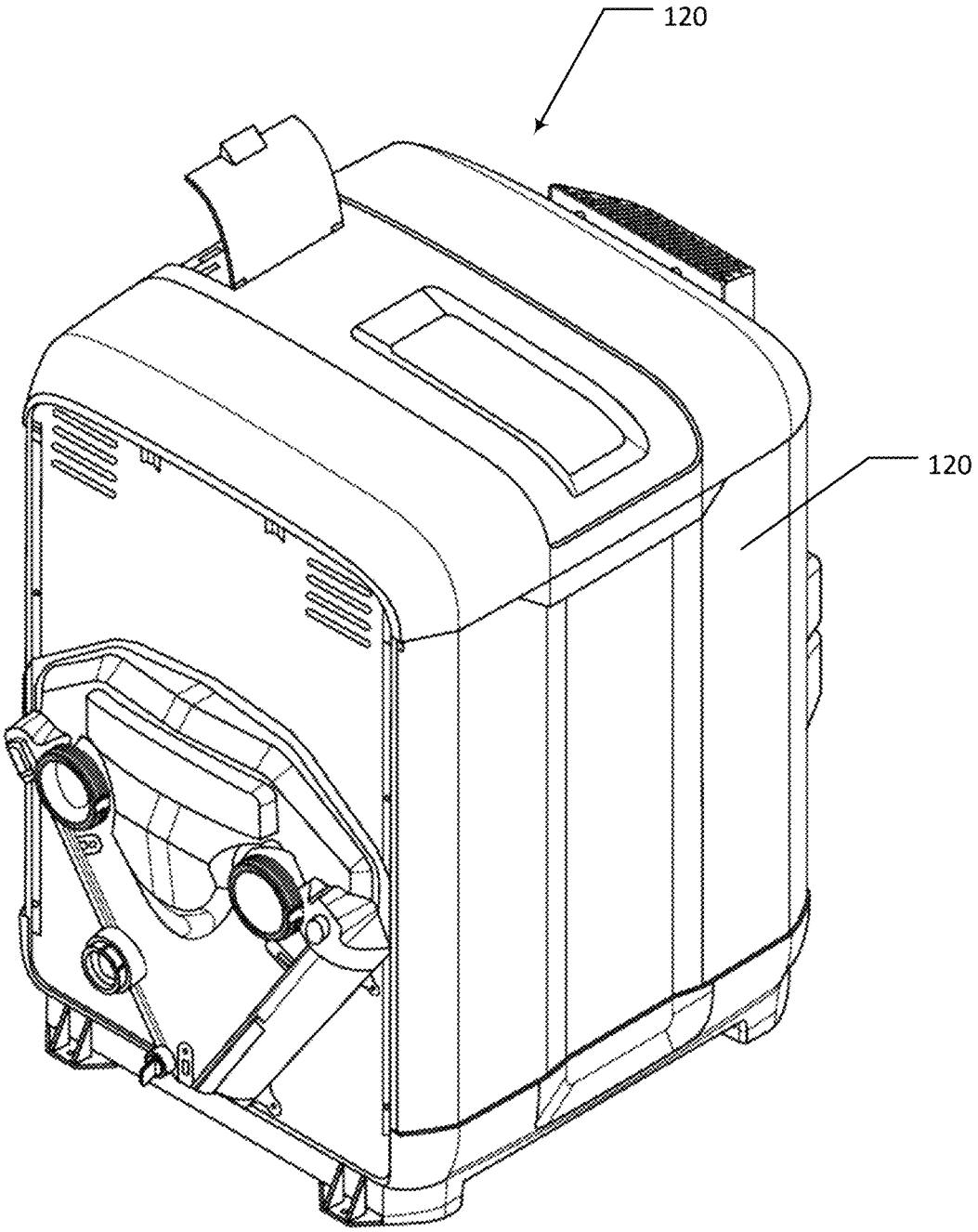
FIG. 12 is a partial first perspective view of an exemplary pool or spa heater in accordance with embodiments of the present disclosure.
Figure 13:
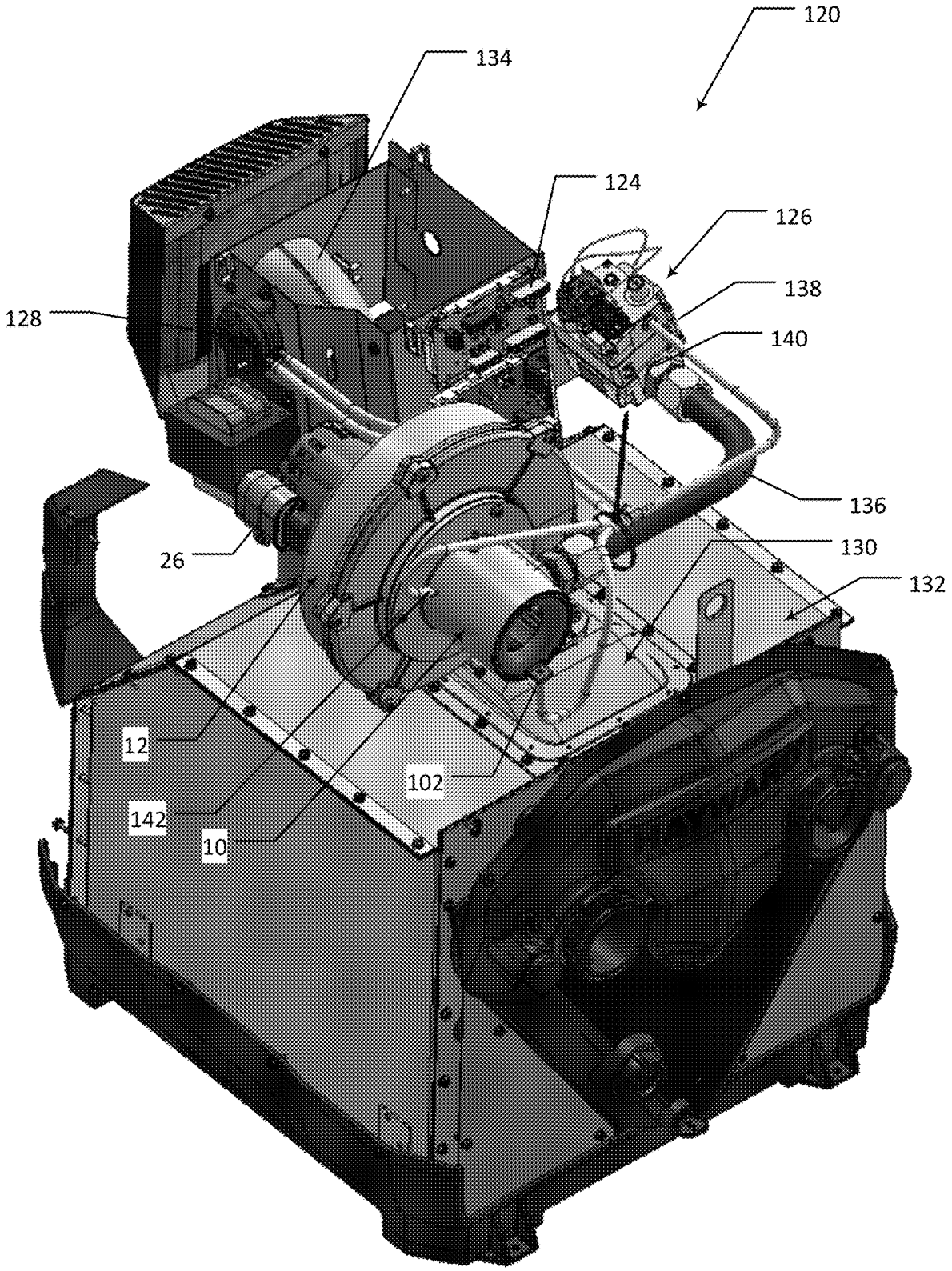
FIG. 13 is a second perspective view of the exemplary pool or spa heater of FIG. 12 with exterior panels removed to show internal components thereof.

FIGS. 12 and 13 illustrate an exemplary pool or spa heater 120 including the inlet mixer 10 in accordance with embodiments of the present disclosure. More specifically, FIG. 12 is a first perspective view of the exemplary pool or spa heater 120 having an exterior cabinet 122 and FIG. 13 is a second perspective view of the exemplary pool or spa heater 120 with the cabinet 122 removed to show internal components thereof.

The heater 120 generally includes the inlet mixer 10 coupled to the combustion blower 12 as described herein, a main PCB 124 for controlling operation of the heater 120, a gas valve 126, a blower vacuum switch 128 coupled to the reference tap 102 and a negative pressure tap 142 disposed through the inlet mixer 10 adjacent the combustion blower inlet 22, a burner 130, a combustion chamber 132, an exhaust pipe 134, and a gas pipe 136.

The gas valve 126 generally includes an inlet (not shown), a valve body 138, and an outlet 140. The inlet of the gas valve 126 can be connected with a gas inlet pipe (not shown), such that fuel gas, e.g., propane or natural gas, is provided to the inlet and thus to the gas valve 126. The gas valve 126 functions to allow, restrict, and/or prevent the flow of gas from the inlet to the outlet 140. The outlet 140 of the gas valve 140 is connected with, and provides gas to, the inlet mixer 10 via the gas pipe 136. As described in connection with FIG. 2, the inlet mixer 10 is coupled to the blower inlet 22 of the combustion blower 12, and provides a mixture of air drawn from atmosphere and gas drawn through the orifices 82 of the mixer insert 16 to the combustion blower 12. As described above, the inlet mixer 10 can be configured to switch between multiple gas sources, e.g., propane and natural gas, connected thereto, by replacing a first mixer insert 16 configured for use with a first gas with a second mixer insert 16 configured for use with a second gas, thereby converting the heater 120 for use with the first fuel gas to the second fuel gas.

As described above, the combustion blower 12 can include the blower inlet 22, the motor 26, impeller 27, and the outlet 24 and a mixture of air and gas is provided to the combustion blower 12 through the blower inlet 22. The motor 26 and impeller 27 draw air and gas into the blower 12 from the inlet mixer 10, and discharge the mixture through the outlet 24 and into the burner 130 and combustion chamber 132 for combustion to heat pool or spa water being circulated through the heater 120.

While exemplary embodiments of the inlet mixer 10 of the present disclosure have been described in connection with gas-fired swimming pool and spa heaters, the inlet mixer 10 can also be used in connection with any application which utilizes a pre-mix combustion system. Furthermore, the number and size of the gas orifices 82, as well as the size of the air inlet 80 can be modified to change the fuel/air ratio for a particular application or to make the inlet mixer compatible with another fuel gas. Further still, instead of changing the size and number of orifices 82 to accommodate an alternate fuel gas, the mixer insert 16 could be used to alter fuel/air mixture in positive regulation combustion systems to allow an appliance to function at alternate firing capacities or at different altitudes. The concepts driving the inlet mixer 10 can also be used in other applications where two fluids have to be mixed at set ratios.

While exemplary embodiments have been described herein, it is expressly noted that these embodiments should not be construed as limiting, but rather that additions and modifications to what is expressly described herein also are included within the scope of the disclosure. Moreover, it is to be understood that the features of the various embodiments described herein are not mutually exclusive and can exist in various combinations and permutations, even if such combinations or permutations are not made express herein.

What is claimed is:

1. An inlet mixer system for a swimming pool or spa gas heater, comprising:

a housing having a body with a gas inlet disposed therethrough, the housing configured to be secured in fluid communication with an inlet of a combustion blower;

a first mixer insert configured to be removably positioned within the housing, the first mixer insert having a first body defining a mixing chamber, an air intake, and a first plurality of orifices disposed radially about the first body and extending through the first body, the first plurality of orifices being configured to provide a first volumetric flow rate of a first fuel gas; and a second mixer insert configured to be removably positioned within the housing, the second mixer insert having a second body defining a mixing chamber, an air intake, and a second plurality of orifices disposed radially about the second body and extending through the second body, the second plurality of orifices configured to provide a second volumetric flow rate of a second fuel gas, the second fuel gas being different than the first fuel gas, wherein a dimension of the first plurality of orifices is different than a dimension of the second plurality of orifices and/or a number of the first plurality of orifices is different than a number of the second plurality of orifices, wherein when the first mixer insert is positioned within the housing, the first mixer insert configures the inlet mixer system for use with the first fuel gas, and wherein when the second mixer insert is positioned within the housing, the second mixer insert configures the inlet mixer system for use with the second fuel gas.

2. The inlet mixer system of claim 1, wherein when the first mixer insert is positioned within the housing an annular chamber is formed between the housing and the first mixer insert, the annular chamber being in fluid communication with the gas inlet of the housing and the mixing chamber of the first mixer insert via the first plurality of orifices.

3. The inlet mixer system of claim 2, wherein the inlet mixer system is configured to have the first fuel gas drawn through the gas inlet, into the annular chamber, through the first plurality of orifices, and into the mixing chamber by air drawn through the first mixer insert by the combustion blower.

4. The inlet mixer system of claim 1, wherein when the second mixer insert is positioned within the housing an annular chamber is formed between the housing and the second mixer insert, the annular chamber being in fluid communication with the gas inlet of the housing and the mixing chamber of the second mixer insert via the second plurality of orifices.

5. The inlet mixer system of claim 4, wherein the inlet mixer system is configured to have the second fuel gas drawn through the gas inlet, into the annular chamber, through the second plurality of orifices, and into the mixing chamber by air drawn through the second mixer insert by the combustion blower.

6. The inlet mixer system of claim 1, wherein the housing includes one or more locking tabs configured to engage one or more reciprocal locking tabs of the first mixer insert to removably secure the first mixer insert within the housing.

7. The inlet mixer system of claim 6, wherein the one or more locking tabs of the housing are configured to engage the one or more reciprocal locking tabs of the first mixer insert upon rotation of the first mixer insert within the housing.

8. The inlet mixer system of claim 1, wherein the housing includes one or more locking tabs configured to engage one or more reciprocal locking tabs of the second mixer insert to removably secure the second mixer insert within the housing.

9. The inlet mixer system of claim 8, wherein the one or more locking tabs of the housing are configured to engage the one or more reciprocal locking tabs of the second mixer insert upon rotation of the second mixer insert within the housing.

10. The inlet mixer system of claim 1, wherein the first mixer insert is securable to the housing without the use of tools, and the second mixer insert is securable to the housing without the use of tools.

11. A method of switching a gas heater for a swimming pool or spa from a first configuration for use with a first fuel gas to a second configuration for use with a second fuel gas, comprising the steps of:

removing a first mixer insert from a housing secured in fluidic communication with an inlet of a combustion blower having a body with a gas inlet disposed therethrough, the first mixer insert having a first body defining a mixing chamber, an air intake, and a first plurality of orifices disposed radially about the first body and extending through the first body, the first plurality of orifices being configured to provide a first volumetric flow rate of a first fuel gas, the first mixer insert configuring the gas heater for use with the first fuel gas when positioned within the housing;

positioning a second mixer insert within the housing, the second mixer insert having a second body defining a mixing chamber, an air intake, and a second plurality of orifices disposed radially about the second body and extending through the second body, a dimension of the first plurality of orifices being different than a dimension of the second plurality of orifices and/or a number of the first plurality of orifices being different than a number of the second plurality of orifices, the second plurality of orifices configured to provide a second volumetric flow rate of a second fuel gas, the second fuel gas being different than the first fuel gas; and securing the second mixer insert within the housing, the second mixer insert configuring the gas heater for use with the second fuel gas when positioned within the housing.

12. The method of claim 11, wherein positioning the second mixer insert within the housing forms an annular chamber within the housing, the annular chamber in fluid communication with the gas inlet of the housing and the mixing chamber of the second mixer insert via the second plurality of orifices.

13. The method of claim 12, wherein the housing and the second mixer insert are configured to have the second fuel gas drawn through the gas inlet, into the annular chamber, through the second plurality of orifices, and into the mixing chamber by air drawn through the second mixer insert by the combustion blower.

14. The method of claim 11, comprising:

rotating the first mixer insert in a first direction to disengage reciprocal locking tabs of the first mixer insert from locking tabs of the housing.

15. The method of claim 14, wherein the securing step comprises:

rotating the second mixer insert in a second direction that is opposite the first direction to engage reciprocal locking tabs of the second mixer insert with locking tabs of the housing.

16. The inlet mixer system of claim 11, wherein removing the first mixer insert from the housing includes removing the first mixer insert from the housing without using tools, and securing the second mixer insert within the housing includes securing the second mixer insert within the housing without using tools.

17. A gas heater for a swimming pool or spa, comprising:

a cabinet defining an interior;

a combustion chamber;

a combustion blower;

a burner positioned within the combustion chamber, the burner receiving combustible gas from the combustion blower and configured to dissipate the combustible gas; and an inlet mixer comprising:

a housing having a body with a gas inlet disposed therethrough, the housing configured to be secured in fluid communication with an inlet of a combustion blower;

a first mixer insert configured to be removably positioned within the housing, the first mixer insert having a first body defining a mixing chamber, an air intake, and a first plurality of orifices disposed radially about the first body and extending through the first body, the first plurality of orifices being configured to provide a first volumetric flow rate of a first fuel gas; and a second mixer insert configured to be removably positioned within the housing, the second mixer insert having a second body defining a mixing chamber, an air intake, and a second plurality of orifices disposed radially about the second body and extending through the second body, the second plurality of orifices configured to provide a second volumetric flow rate of a second fuel gas, the second fuel gas being different than the first fuel gas, wherein a dimension of the first plurality of orifices is different than a dimension of the second plurality of orifices and/or a number of the first plurality of orifices is different than a number of the second plurality of orifices, wherein when the first mixer insert is positioned within the housing, the first mixer insert configures the inlet mixer system for use with the first fuel gas, wherein when the second mixer insert is positioned within the housing, the second mixer insert configures the inlet mixer system for use with the second fuel gas, and wherein the combustion chamber, the burner, the combustion blower, and the inlet mixer are positioned within the interior of the cabinet.

18. The gas heater of claim 17, wherein when the first mixer insert is positioned within the housing an annular chamber is formed between the housing and the first mixer insert, the annular chamber being in fluid communication with the gas inlet of the housing and the mixing chamber of the first mixer insert via the first plurality of orifices.

19. The gas heater of claim 18, wherein the combustion blower is configured to draw air through the first mixer insert, and draw the first fuel gas through the gas inlet, into the annular chamber, through the first plurality of orifices, into the mixing chamber, and into the inlet of the combustion blower.

20. The gas heater of claim 17, wherein when the second mixer insert is positioned within the housing an annular chamber is formed between the housing and the second mixer insert, the annular chamber being in fluid communication with the gas inlet of the housing and the mixing chamber of the second mixer insert via the second plurality of orifices.

21. The gas heater of claim 20, wherein the combustion blower is configured to draw air through the second mixer insert, and draw the first fuel gas through the gas inlet, into the annular chamber, through the first plurality of orifices, into the mixing chamber, and into the inlet of the combustion blower.

22. The gas heater of claim 17, wherein the housing includes one or more locking tabs configured to engage one or more reciprocal locking tabs of the first mixer insert to removably secure the first mixer insert within the housing.

23. The gas heater of claim 22, wherein the one or more locking tabs of the housing are configured to engage the one or more reciprocal locking tabs of the first mixer insert upon rotation of the first mixer insert within the housing.

24. The gas heater of claim 17, wherein the housing includes one or more locking tabs configured to engage one or more reciprocal locking tabs of the second mixer insert to removably secure the second mixer insert within the housing.

25. The gas heater of claim 24, wherein the one or more locking tabs of the housing are configured to engage the one or more reciprocal locking tabs of the second mixer insert upon rotation of the second mixer insert within the housing.

26. The gas heater of claim 17, wherein the first mixer insert is securable to the housing without the use of tools, and the second mixer insert is securable to the housing without the use of tools.

27. An inlet mixer kit for a pool swimming pool or spa gas heater, comprising:

a housing having a body with a gas inlet disposed therethrough, the housing being removably securable in fluid communication with an inlet of a combustion blower;

a first mixer insert having a first body defining a mixing chamber, an air intake, and a first plurality of orifices disposed radially about the first body and extending through the first body, the first plurality of orifices being configured to provide a first volumetric flow rate of a first fuel gas, the first mixer insert being removably positionable within the housing; and a second mixer insert having a second body defining a mixing chamber, an air intake, and a second plurality of orifices disposed radially about the second body and extending through the second body, the second plurality of orifices configured to provide a second volumetric flow rate of a second fuel gas, the second fuel gas being different than the first fuel gas, the second mixer insert being removably positionable within the housing, wherein a dimension of the first plurality of orifices is different than a dimension of the second plurality of orifices and/or a number of the first plurality of orifices is different than a number of the second plurality of orifices, wherein when the first mixer insert is positioned within the housing, the first mixer insert configures the inlet mixer system for use with the first fuel gas, and wherein when the second mixer insert is positioned within the housing, the second mixer insert configures the inlet mixer system for use with the second fuel gas.

28. The inlet mixer kit of claim 27, wherein when the first mixer insert is positioned within the housing an annular chamber is formed between the housing and the first mixer insert, the annular chamber being in fluid communication with the gas inlet of the housing and the mixing chamber of the first mixer insert via the first plurality of orifices.

29. The inlet mixer kit of claim 28, wherein the inlet mixer system is configured to have the first fuel gas drawn through the gas inlet, into the annular chamber, through the first plurality of orifices, and into the mixing chamber by air drawn through the first mixer insert by the combustion blower.

30. The inlet mixer kit of claim 27, wherein when the second mixer insert is positioned within the housing an annular chamber is formed between the housing and the second mixer insert, the annular chamber being in fluid communication with the gas inlet of the housing and the mixing chamber of the second mixer insert via the second plurality of orifices.

31. The inlet mixer kit of claim 30, wherein the inlet mixer system is configured to have the second fuel gas drawn through the gas inlet, into the annular chamber, through the second plurality of orifices, and into the mixing chamber by air drawn through the second mixer insert by the combustion blower.

32. The inlet mixer kit of claim 27, wherein the housing includes one or more locking tabs configured to engage one or more reciprocal locking tabs of the first mixer insert to removably secure the first mixer insert within the housing.

33. The inlet mixer kit of claim 32, wherein the one or more locking tabs of the housing are configured to engage the one or more reciprocal locking tabs of the first mixer insert upon rotation of the first mixer insert within the housing.

34. The inlet mixer kit of claim 27, wherein the housing includes one or more locking tabs configured to engage one or more reciprocal locking tabs of the second mixer insert to removably secure the second mixer insert within the housing.

35. The inlet mixer kit of claim 34, wherein the one or more locking tabs of the housing are configured to engage the one or more reciprocal locking tabs of the second mixer insert upon rotation of the second mixer insert within the housing.

36. The inlet mixer kit of claim 27, wherein the first mixer insert is securable to the housing without the use of tools, and the second mixer insert is securable to the housing without the use of tools.

* * * * *